United States Patent [19]

Roeder

[11] 4,285,215

[45] Aug. 25, 1981

[54] ROTARY TABLE AND KELLY GUARD

[76] Inventor: George K. Roeder, Box 4335, Odessa, Tex. 79760

[21] Appl. No.: 733,113

[22] Filed: Oct. 18, 1976

[51] Int. Cl.[3] ..... F16D 3/06

[52] U.S. Cl. ..... 64/23.5; 175/219; 173/165

[58] Field of Search ..... 64/23.5, 23.6, 23.7; 175/195, 209, 210, 211, 219; 173/165, 166, 167; 74/608, 609, 18, 18.1, 18.2; 408/241 R, 67

[56] References Cited

U.S. PATENT DOCUMENTS

| | | | |
|---|---|---|---|
| 1,496,948 | 6/1924 | Schutt | 408/241 X |
| 2,344,746 | 3/1944 | Spalding | 64/23.5 |
| 2,559,100 | 7/1951 | White | 64/23.6 |
| 2,763,468 | 9/1956 | Abegg | 173/167 X |
| 3,910,359 | 10/1975 | Childress | 175/219 X |
| 3,913,352 | 10/1975 | Oliver | 64/23.5 |

*Primary Examiner*—Charles J. Myhre
*Assistant Examiner*—Magdalen Moy
*Attorney, Agent, or Firm*—Marcus L. Bates

[57] ABSTRACT

A kelly bushing guard which encapsulates the rotating parts of a rotary table of a rotary drilling rig. The guard includes a shoe which rests on the fixed floor area of the table. The rotating center is located inwardly of the shoe. A bearing member has a fixed housing and a rotating center member. The fixed housing is attached to the shoe by a circumferentially extending wall member while the center member rotates with and slidably receives the kelly therethrough.

The kelly can be lifted from the kelly bushing carrying the guard therewith so that the floor is unobstructed and the inner slip bowl is free to receive a set of slips or the like.

9 Claims, 11 Drawing Figures

ROTARY TABLE AND KELLY GUARD

BACKGROUND OF THE INVENTION

Rotary drilling rigs for forming boreholes require a rotary table centrally positioned on the floor of the drilling rig. The rotary table has a rotating center which receives a kelly bushing therein which imparts rotation into a kelly. The kelly is free to slide within the bushing and has a string of drill pipe connected at the lower end and a swivel at the upper end thereof.

The rotating table center and kelly bushing usually have bolt heads, fastener heads, and various other protrusions as well as various different indentions formed thereon. This is especially so on the older rotary drilling rigs.

The roughnecks working on the confined floor of a drilling rig must handle cables, chains, ropes, water hoses, and various hand and power tools. All of this is carried out in an extremely small floor area and from time to time a tool will inadvertently fall onto the rotating table center and centrifugal force throws the tool outwardly where it may strike a workman.

Now and then a roughneck will accidently get the end of a chain, rope, or hose caught in the rotary, which usually results in a fatal injury.

Drillers and pushers take great care to protect their roughnecks but they cannot always prevent one from entangling a piece of equipment in the inherently dangerous rotating mass of the drilling rig.

Accordingly, it is advantageous and highly desirable to encapsulate the rotary table of a drilling rig so as to isolate this dangerous area from the workmen so that should one accidently drop anything on the rig floor, it cannot possibly be caught in the rotating center.

SUMMARY OF THE INVENTION

This invention relates to drilling rig safety equipment, and specifically to a guard for a rotary table and a kelly, such as may be found on a rotary drilling rig or a workover unit. The guard of this invention has a lower end in the form of a flat circular show member from which there upwardly extends a wall member. The upper end of the wall member terminates at a bearing means. The bearing means is spaced from and concentrically arranged respective to the shoe, and has a rotatable part which slidably receives a marginal length of the kelly therethrough. The rotating kelly rotates the rotatable part of the bearing while the remainder of the bearing means remains stationary. Hence, the guard encapsulates the most dangerous parts of the rotary table and kelly and prevents extraneous items from falling into contact therewith.

Therefore, a primary object of the present invention is the provision of a non-rotating guard about a kelly and rotary table of a drilling rig.

Another object of the present invention is to provide apparatus which will prevent extraneous members from contacting the rotating parts associated with a rotary table of a drilling rig or the like.

A still further object of the present invention is to encapsulate the dangerous rotating parts of a rotary table within a non-rotating guard device.

Another and still further object of this invention is to disclose and provide a safety structure which prevents contact of anything with the dangerous rotating parts of a rotary table.

A still further object of this invention is to provide a guard in the form of a non-rotating safety shield located about the rotating parts of a rotary table so that nothing can inadvertently contact the rotating parts.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

This invention relates to a rotary table and kelly bushing guard for use in conjunction with a drilling rig, workover rig, or the like. In drilling boreholes, the massive rotary table, kelly, and kelly bushing are exposed in the center of the greatest activity of the drilling operation. From time to time, a roughneck will inadvertently catch a hose or chain or the like in the rotating mass, whereupon he often is violently thrown into the apparatus and fatally injured. Accordingly, the apparatus of the present invention isolates this dangerous mechanism from the surrounding area so that extraneous material cannot inadvertently come into contact therewith.

Figure 1:
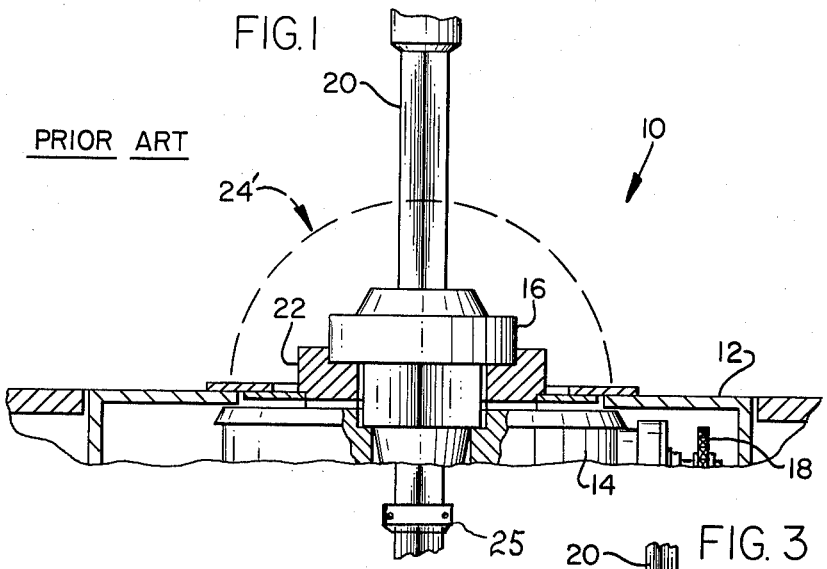
FIG. 1 PRIOR ART
FIG. 1 is a diagrammatical representation of a rotary table and kelly used in borehole forming operations.

As seen in FIG. 1, a derrick floor 10 of a rotary drilling rig includes the non-rotating, circumferentially extending floor area 12 which overlies a rotary mechanism 14. The mechanism imparts rotation into a kelly bushing 16 by means of a drive sprocket 18 connected to the end of a pinion shaft of the rotary device. The kelly 20 is slidably received in a telescoping manner through the kelly bushing 16 in the usual manner, while drive mechanism 22 removably receives the kelly bushing 16 in the usual manner. As mechanism 16, 20, and 22 rotate respective to the fixed floor 12, there is a danger area 24' which must be avoided. There is always the grave danger that someone will somehow or another slip and fall into the danger area and thereby become severely injured.

In order to obviate this catastrophe, a rotary table and kelly bushing guard 24, made in accordance with the FIGS. 2—11 of the present invention, is slidably received about the kelly 20, thereby encapsulating the dangerous rotating mechanism of the drilling rig. The guard 24 includes an upper member in the form of bearing means 26 which slidably receives the rotating kelly therethrough. A heavy rubber shoe 28 forms a lower support member and is supported by the non-rotating area located outwardly of the rotary table, while a mid-portion 30 in the form of a circumferentially extending wall interconnects the bearing means 26 with the shoe 28.

Radially spaced apart ribs 32 are connected between the bearing means 26 and shoe 28, and between the ribs there is provided a plurality of radially spaced apart wall members 34 which extend from and are attached to the adjacent ribs, to the bearing means, and to the shoe.

Figure 4:
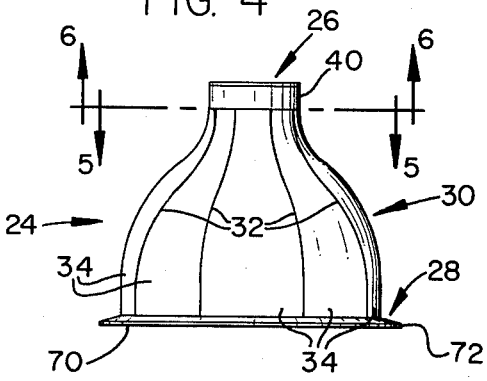
FIG. 4 is a side elevational view of part of the apparatus disclosed in FIG. 2.
Figure 5:
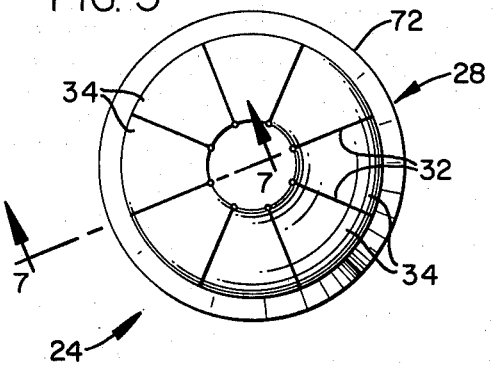
FIG. 5 is a cross-sectional view taken along line 5—5 of FIG. 4.
Figure 8:
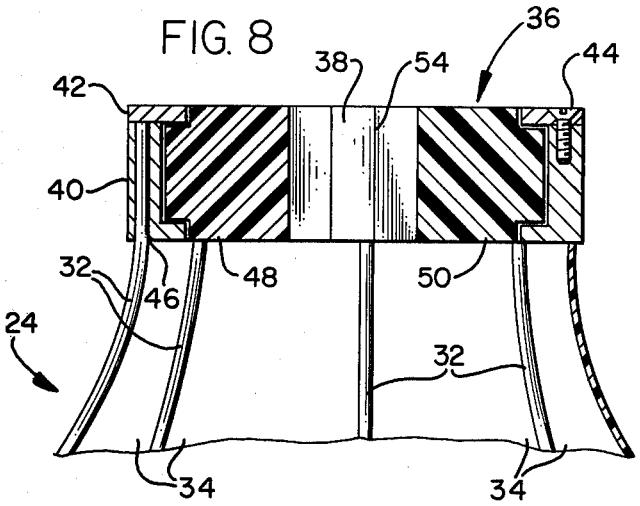
FIG. 8 is an enlarged, cross-sectional detail taken along line 8—8 of FIG. 6.

Hence, the upper, circumferentially extending edge of the wall member 34 is attached to the upper member 26 as noted in FIG. 8, while the lower edge of the wall member is attached to the shoe as seen near numeral 28 in FIG. 4, for example.

Figure 6:
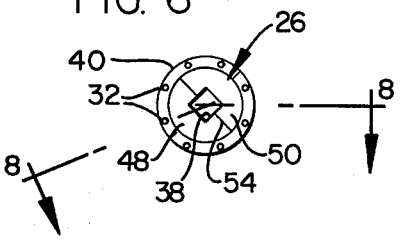
FIG. 6 is a cross-sectional view taken along line 6—6 of FIG. 4.
Figure 7:
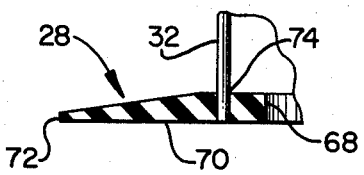
FIG. 7 is an enlarged, part cross-sectional view taken along line 7—7 of FIG. 5.

As seen in FIGS. 6 and 8, together with other figures of the drawing, the bearing means includes Teflon rotatable member 36 within which there is formed an axial passageway 38 which slidably mates and rotates with the kelly 20. Bearing housing 40 is of annular configuration and preferably has the upper marginal end of ribs 32 molded therewithin. Washer 42 is split as indicated at 43 and is removably affixed to the fixed housing 40 by means of a plurality of fasteners 44 so that the rotating member 36 is captured in low friction relationship within the non-rotating member 40. This expedient enables the rotating member 36 to slidably receive and rotate with kelly 20 while non-rotating member 40 is held in a non-rotatable manner respective to the derrick floor and to the mid-portion 30.

Ribs 32 downwardly extend from the fixed upper housing member 40, as indicated by numeral 46. Member 36 is split into portions 48 and 50 so that the spaced fastener means 52 can be utilized for assembling the apparatus onto the kelly. Numeral 54 is the interface formed between the two members. The fasteners are received through apertures 56 and can include self-locking nuts and the like as may be desired.

Figure 9:
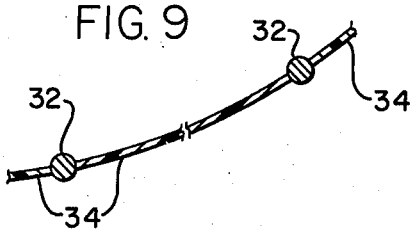
FIG. 9 is a cross-sectional detail which illustrates one form of the present invention.

In the embodiment of the invention disclosed in FIG. 9, the plastic well member 34 is preferably deformable sufficiently to enable the ribs to be slightly bowed in an outward direction as noted in the above figures of the drawings. The edge portions of member 34 are attached to the ribs 32 by cementing, heat welding, or by a tongue and groove fitting which enables the web 34 to engage the rib 32 with a hinge-like action.

Figure 10:
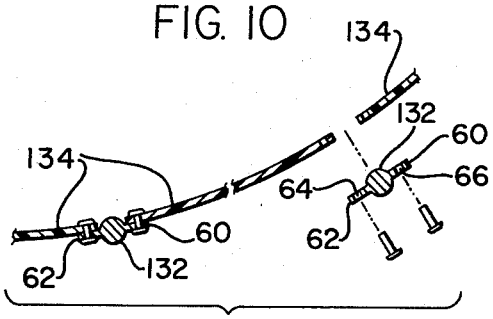
FIG. 10 is a modification of FIG. 9.
Figure 11:
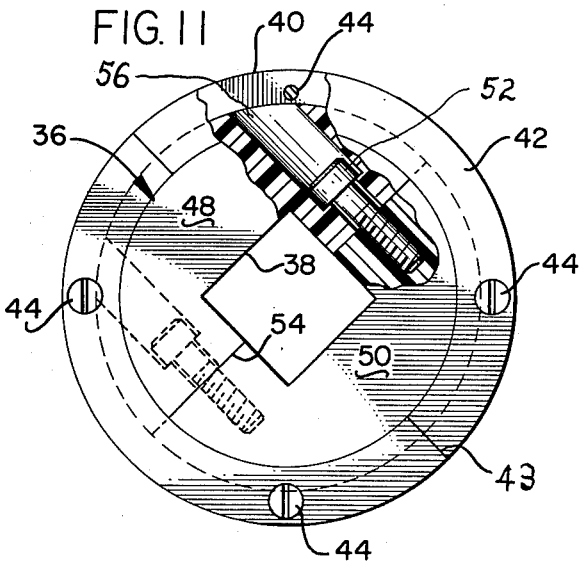
FIG. 11 is a part cross-sectional top plan view of FIG. 8.

In FIG. 10, ribs 132 are provided with diametrically opposed, longitudinally extending web members 60, 62 which are loosely attached to the resilient cover 134 by means of the slotted apertures 64, 66 and the illustrated fasteners.

In operation, fasteners 44 are removed to permit the two halves of washer 42 to be removed from the Teflon bearing assembly located at the upper end of the safety guard 24. Fasteners 52 are removed in order to split the rotating bearing member into halves 48 and 50 thereby facilitating assembly. The halves are placed about the kelly in the illustrated manner of FIG. 2. Stop member 25 preferably is a clamp device smaller in diameter than the pin or threaded male end of the kelly, and is tapered at the lower end to facilitate entrance through the kelly bushing and into the rat hole. The clamp holds the guard in the illustrated position of FIG. 3.

Bearing member 36 slidably engages the kelly for axial movement so that the kelly can continuously move in a downward direction as drilling progresses. When the kelly is lifted from the rotating table, the bearing means 36 of the protector device of the present invention engages the stop 25 and is lifted therewith in the manner of FIG. 3 so that another joint of drill pipe can be added to the drill string.

Hence, the rotating Teflon bearing axially slides respective to the kelly and captures the kelly therewithin so that it is rotated therewith. The heavy plastic guard cover 30 is nonrotatable and does not turn during kelly operation. The guard cover prevents one from inadvertently falling or stepping onto the rotary table, and furthermore prevents objects such as chains or hoses or ropes from catching the rotary table or kelly, and being wound thereabout, causing possible injury to adjacent personnel.

Figure 2:
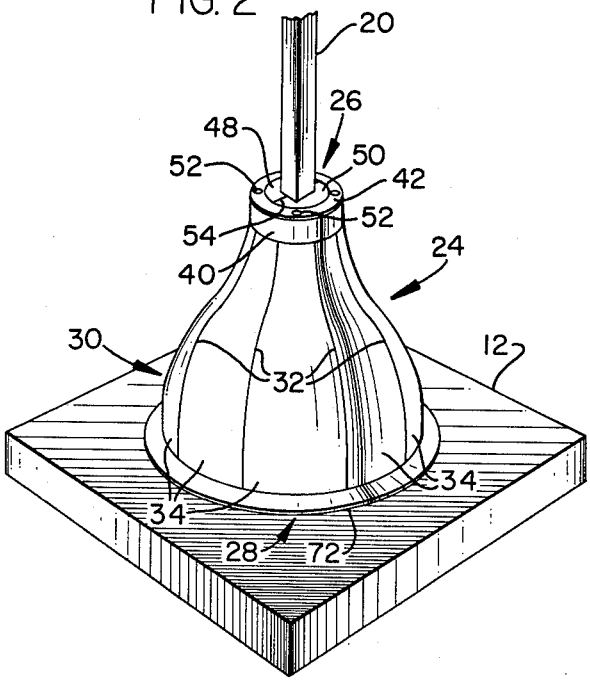
FIG. 2 is an idealized perspective view of the apparatus disclosed in FIG. 1, with a guard means made in accordance with the present invention being associated therewith.
Figure 3:
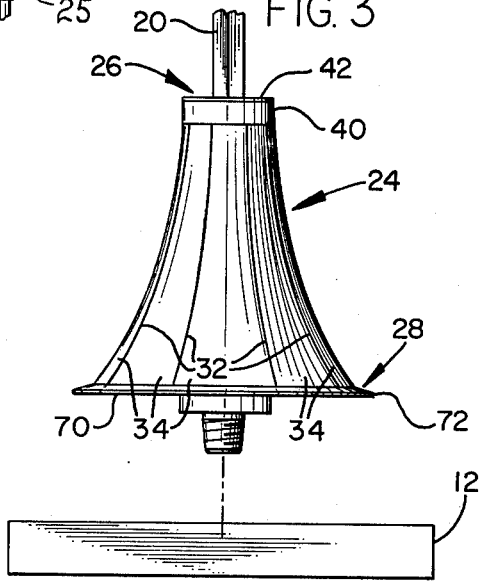
FIG. 3 is a side elevational view of the apparatus disclosed in FIG. 2.

The heavy rubber shoe is located at the lower end of the safety guard. The shoe is provided with the illustrated small inside diameter 68 which forms a heel and tapers in an outward direction and terminates in a toe at large outside diameter 72. The bottom of the shoe is seen at 70. The marginal lower end of members 32 are imbedded within the shoe as noted by the numeral 74. This configuration forms a low profile so that a roughneck will not inadvertently stump his toe on the shoe. The present invention can be used in conjunction with any type of drilling or workover unit having a rotary table thereon. The non-rotating slidable safety guard of the present invention can be made of plastic, fiberglass, rubber, or metal, as shown in FIGS. 2 and 4. The safety guard can be left on the kelly and need not be removed for extended periods of time.

The center of the rotating bearing 36 can be made square as illustrated or hexagon to accommodate a hex shaped kelly as well as being made in other configurations for accommodating any other type kelly.

I claim:

1. A safety guard in combination with a kelly bushing, a kelly, and a rotary table of a rotary drilling rig;

said guard comprising an annular shoe for abuttingly engaging a non-rotating floor area outwardly of the rotary table;

a bearing means spaced from said shoe, including a rotating member which rotates with said slidably receives a marginal length of the kelly therewithin;

said bearing means includes a fixed housing, said rotating member being rotatably captured in low friction relationship within said housing;

a circumferentially extending wall having a circumferentially extending upper end affixed to said housing and a circumferentally extending bottom end affixed to said shoe;

so that said guard encapsulates the rotary table, kelly bushing, and a marginal length of a kelly.

2. The guard of claim 1 wherein said shoe includes a small inside diameter which forms a relatively thick heel and an outside diameter which forms a relatively thin toe.

3. The safety guard of claim 1 wherein said rotating member of said bearing means has a central aperture made complementary respective to the cross sectional configuration of the kelly, said rotating member being made in halves which are joined together by fastener means to enable said member to be placed about the kelly in close tolerance relationship therewith.

4. The combination of claim 1 wherein said circumferentially extending wall is comprised of radially spaced apart ribs having opposed ends, one opposed end of each rib being affixed to said housing and the remaining end being affixed to said shoe, and a relatively flexible wall being affixed in supported relationship to said ribs to thereby completely enclose the rotary table and kelly bushing therewithin.

5. The combination of claim 4 wherein said shoe includes an inside diameter which forms a relatively thick heel at the innermost part thereof, and an outside diameter which forms a relatively thin toe at the outside thereof.

6. The combination of claim 5 wherein said rotating member of said bearing means includes a central aperture made complementary respective to the cross-sectional configuration of the kelly, said member being made in halves which are joined together by a fastener means to enable said memberto be removably placed about a marginal midportion of the length of the kelly in close tolerance relationship therewith.

7. The combination of claim 6 wherein said ribs and wall are made of plastic.

8. A kelly bushing guard for completely enclosing the rotating center of a rotary drilling rig, said guard comprises a lower support member, an upper member through which a kelly is telescopingly received, and a wall member; said lower support member lies in a horizontal plane and bottom supports the guard from a fixed floor area which lies outwardly of the rotating center; said wall having a lower peripheral edge attached to said lower support member, said wall extends completely about the rotating center; said wall upwardly and inwardly slopes and terminates in an upper peripheral edge which is in fixed engagement with respect to said upper member;

said lower support member is in the form of a shoe, said shoe is of annular configuration and includes a relatively thick heel at the inside thereof and a relatively thin toe at the outside thereof;

said upper member includes a bearing means, said bearing means includes a rotating member which is apertured complementary respective to the cross-sectional configuration of the kelly, said rotating member of said bearing means being made in segments and said segments are joined together by a fastener means to enable said rotating member to be removably placed about the kelly in close tolerance relationship therewith, such that a medial length of the kelly is slidably received within the rotating member; and further includes a bearing housing which is attached to said wall and which rotatably receives said rotating member therewithin.

9. The kelly bushing guard of claim 8 wherein said wall is comprised of radially spaced apart ribs having opposed ends, one end of a rib being affixed to said upper member and the remaining end being affixed to said lower support member; and a relatively flexible sheet of material being affixed to said ribs to thereby form said wall.

* * * * *